US009017908B2

(12) United States Patent
Yu et al.

(10) Patent No.: US 9,017,908 B2
(45) Date of Patent: Apr. 28, 2015

(54) PHOTOELECTRICAL STABLE IMAGING MEMBERS

(71) Applicant: Xerox Corporation, Norwalk, CT (US)

(72) Inventors: Robert C. U. Yu, Webster, NY (US); Stephen T. Avery, Rochester, NY (US); Jimmy E. Kelly, Rochester, NY (US); Mark Muscato, Webster, NY (US); J. Robinson Cowdery-Corvan, Webster, NY (US); David Skinner, Rochester, NY (US); Dennis J. Prosser, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/959,435

(22) Filed: Aug. 20, 2013

(65) Prior Publication Data

US 2015/0056546 A1 Feb. 26, 2015

(51) Int. Cl.

| | |
|---|---|
| ***G03G 15/02*** | (2006.01) |
| ***G03G 15/00*** | (2006.01) |
| ***G03G 5/047*** | (2006.01) |
| ***G03G 5/05*** | (2006.01) |

(52) U.S. Cl.

CPC ..... *G03G 5/047* (2013.01); *G03G 5/0564* (2013.01)

(58) Field of Classification Search

USPC ..... 430/58.05, 58.25, 70, 96; 399/26, 96, 399/159

See application file for complete search history.

(56) References Cited

U.S. PATENT DOCUMENTS

| | | | | |
|---|---|---|---|---|
| 3,121,006 | A | | 2/1964 | Middleton et al. |
| 3,820,989 | A | | 6/1974 | Rule et al. |
| 3,837,851 | A | | 9/1974 | Shattuck et al. |
| 3,895,944 | A | | 7/1975 | Wiedemann et al. |
| 4,150,987 | A | | 4/1979 | Anderson et al. |
| 4,245,021 | A | | 1/1981 | Kazami et al. |
| 4,256,821 | A | | 3/1981 | Enomoto et al. |
| 4,265,990 | A | | 5/1981 | Stolka et al. |
| 4,278,746 | A | | 7/1981 | Goto et al. |
| 4,286,033 | A | | 8/1981 | Neyhart et al. |
| 4,291,110 | A | | 9/1981 | Lee |
| 4,297,426 | A | | 10/1981 | Sakai et al. |
| 4,298,491 | A | | 11/1981 | Coxon et al. |
| 4,307,167 | A | * | 12/1981 | Bowden et al. ..... 430/58.55 |
| 4,315,982 | A | | 2/1982 | Ishikawa et al. |
| 4,338,387 | A | | 7/1982 | Hewitt |
| 4,338,388 | A | | 7/1982 | Sakai et al. |
| 4,385,106 | A | | 5/1983 | Sakai |
| 4,387,147 | A | | 6/1983 | Sakai |
| 4,399,207 | A | | 8/1983 | Sakai et al. |
| 4,399,208 | A | | 8/1983 | Takasu et al. |

(Continued)

OTHER PUBLICATIONS

Damodar M. Pai, U.S. Appl. No. 10/655,882, filed Sep. 5, 2003, Now Patent No. 7,018,756, Issued Mar. 28, 2006.

*Primary Examiner* — Thorl Chea

(74) *Attorney, Agent, or Firm* — Pillsbury Winthrop Shaw Pittman LLP

(57) ABSTRACT

The presently disclosed embodiments are directed to flexible imaging members used in electrophotographic imaging apparatuses. More particularly, the embodiments pertain to electrophotographic imaging members which have imaging layer(s) formulated to comprise of a novel polymer blended binder comprising a bisphenol type polycarbonate and an organic acid-containing copolyester doped into the polycarbonate which provides improved properties and performance to the resulting imaging member. The formulated imaging layer(s) may further include a plasticizer.

20 Claims, 4 Drawing Sheets

(56) References Cited

U.S. PATENT DOCUMENTS

| | | | | |
|---|---|---|---|---|
| 4,587,189 | A | 5/1986 | Hor et al. | |
| 4,664,995 | A | 5/1987 | Horgan et al. | |
| 4,988,597 | A | 1/1991 | Spiewak et al. | |
| 5,215,839 | A | 6/1993 | Yu | |
| 5,244,762 | A | 9/1993 | Spiewak et al. | |
| 5,660,961 | A | 8/1997 | Yu | |
| 5,697,024 | A | 12/1997 | Mishra | |
| 5,703,487 | A | 12/1997 | Mishra | |
| 5,756,245 | A | 5/1998 | Esteghamatian et al. | |
| 5,958,638 | A | 9/1999 | Katayama et al. | |
| 6,008,653 | A | 12/1999 | Popovic et al. | |
| 6,119,536 | A | 9/2000 | Popovic et al. | |
| 6,124,514 | A | 9/2000 | Emmrich et al. | |
| 6,214,514 | B1 | 4/2001 | Evans et al. | |
| 6,326,111 | B1 | 12/2001 | Chambers et al. | |
| 6,756,169 | B2 | 6/2004 | Lin et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,413,835 | B2 | 8/2008 | Lin et al. | |
| 7,592,111 | B2 | 9/2009 | Yu et al. | |
| 8,470,505 | B2 * | 6/2013 | Yu et al. | 430/59.6 |
| 2010/0297544 | A1 * | 11/2010 | Yu et al. | 430/56 |
| 2011/0305981 | A1 * | 12/2011 | Yu et al. | 430/56 |

* cited by examiner

PHOTOELECTRICAL STABLE IMAGING MEMBERS

BACKGROUND

The presently disclosed embodiments are directed to imaging members used in electrophotography. More particularly, the embodiments are pertaining to electrophotographic imaging member which has improved imaging layer(s) formulated to consist of utilizing a polymer blended binder that render chemical amine contaminant resistive property to preserve copy printout quality as well as photoelectrical stability. The present disclosure relates to all types of electrophotographic imaging members used in electrophotography.

In electrophotographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Typical electrophotographic imaging members include, for example: photoreceptors commonly utilized in electrophotographic (xerographic) imaging process systems. All of the electrophotographic imaging members are prepared in either flexible belt form or rigid drum configuration. For typical flexible electrophotographic imaging member belt, it comprises a charge transport layer, a charge generating layer, and optional layers on one side of a flexible supporting substrate layer and does also include application of an anticurl back coating on the opposite side of the substrate to render imaging member flatness and complete the imaging member structure. Alternatively, the electrophotographic imaging members can also be prepared as rigid member, such as those utilizing a rigid substrate support drum. For these drum imaging members, having a thick rigid cylindrical supporting substrate bearing the imaging layer(s), there is no exhibition of the curl-up problem, and thus, there is no need for an anticurl back coating layer.

The flexible electrophotographic imaging members may be seamless or seamed belts. Seamed belts are usually formed by cutting a rectangular sheet from a web, overlapping opposite ends, and welding the overlapped ends together to form a welded seam.

Although the scope of the present embodiments covers the preparation of both types of electrophotographic imaging members in either flexible belt design or rigid drum configuration, the discussion hereinafter will focus and be represented only on flexible electrophotographic imaging member belts for reasons of simplicity.

One type of flexible composite photoconductive layer used in xerography is illustrated in U.S. Pat. No. 4,265,990 which describes a photosensitive imaging member having at least two electrically operative layers. One layer comprises a photoconductive layer which is capable of photogenerating holes and injecting the photogenerated holes into a contiguous charge transport layer. Generally, the two electrically operative layers are supported on a conductive layer support substrate, with the photoconductive layer being sandwiched between a contiguous charge transport layer and the supporting conductive layer. In this negatively charged imaging member, the charge transport layer is therefore the top outermost exposed layer. In the alternative imaging member design, the charge transport layer is, however, sandwiched between the supporting electrode and a photoconductive layer. Since the typical flexible electrophotographic imaging members exhibit undesirable upward imaging member curling-up after completion of the electrically operative layers, the application of an anticurl back coating onto the backside of the support substrate is necessary to provide the appropriate imaging members with desirable flatness.

The flexible photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the top outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members should be highly flexible, adhere well to adjacent layers, and exhibit predictable electrical characteristics within narrow operating limits to provide excellent toner images over many thousands of cycles. Typically, negatively charged multilayered flexible photoreceptor that has been employed as a belt in electrophotographic imaging systems comprises a flexible substrate, a conductive layer, an optional blocking layer, an optional adhesive layer, a charge generating layer, a charge transport layer and a conductive ground strip layer adjacent to one edge of the imaging layers. In such a photoreceptor, it does usually further comprise an anticurl back coating layer on the backside of the substrate (opposite the side carrying the conductive layer, support layer, blocking layer, adhesive layer, charge generating layer, charge transport layer, and other layers) to effect curl control for rendering flatness configuration and give a complete structure.

Since the charge transport layer in a negatively charged imaging member is the top outermost exposed layer, it is constantly subjected to chemical vapor contaminants exposure/interaction during electrophotographic imaging process in the field to negatively impact function. For example, exposure to the vapor amine species (from ammonia) emitted from common house cleaning agents have been seen to interact with the imaging member charge transport layer, causing material degradation to promote pre-mature onset of charge transport layer cracking and exacerbation of wear failure which severely cut short the functional life of the imaging member. In one particular instant, amine vapor impact on copy printout quality degradation has recently been seen when pre-printed papers (papers having pre-printed images which employed amine agents catalyzed UV cured ink) are used by customers for subsequent addition of xerographic images over the pre-printed paper blank spaces; that is the accumulation of amine residues deposition onto the imaging member charge transport layer surface, after repeatedly making contact with receiving papers during xerographic imaging process, is found to cause ghosting image defects print-out in the output copies. Since ghosting image defects in the output copies are unacceptable print quality failures, so it does require frequent costly imaging member replacement in the field. With all these issues and failures described above, therefore there is an urgent need to resolve these issues and extend the service life of the imaging member in the field. In particular, by the formulation of a charge transport layer that is resistive to amine specific effect to resolve the current pre-printed paper ghosting image defects print out problem.

Conventional photoreceptors are disclosed in the following patents, a number of which describe the presence of light scattering particles in the undercoat layers: U.S. Pat. No. 5,660,961; U.S. Pat. No. 5,215,839; and U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

In U.S. Pat. No. 7,413,835, there is disclosed an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

In U.S. Pat. No. 7,592,111, issued on Sep. 22, 2009 to Yu, et al., there is disclosed an imaging member formulated with a liquid carbonate. The imaging electrostatographic member exhibits improved service life.

SUMMARY

According to aspects illustrated herein, there is an imaging member comprising: a flexible imaging member comprising: a flexible substrate; a charge generating layer disposed on a first side of the substrate; and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

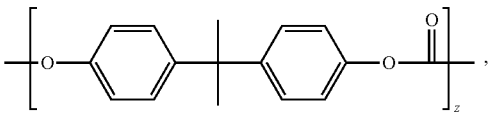

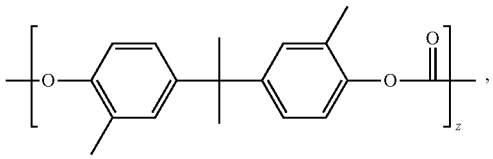

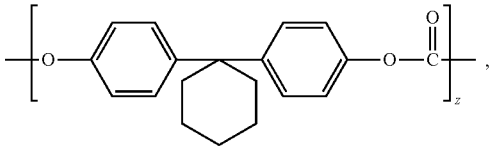

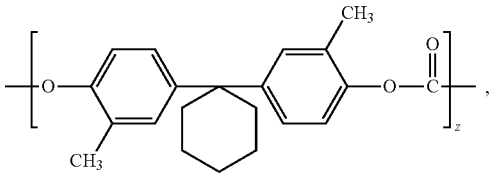

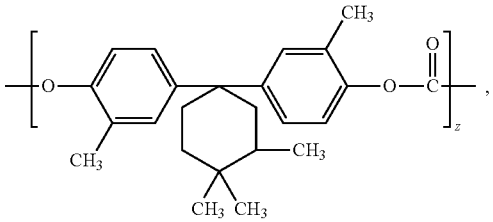

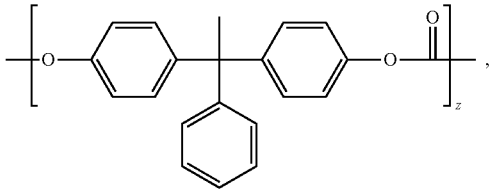

and mixtures thereof, wherein z represents the degree of polymerization and is from about 20 to about 80.

Another embodiment provides an imaging member comprising: a flexible imaging member comprising: a flexible substrate; a charge generating layer disposed on a first side of the substrate; and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

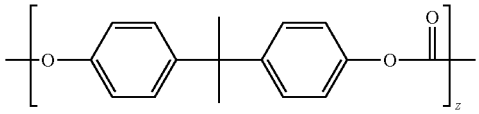

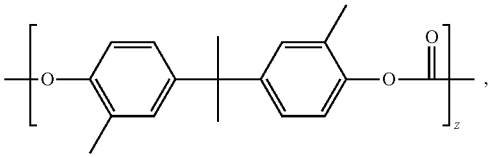

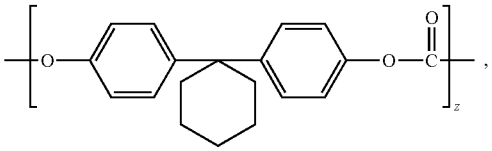

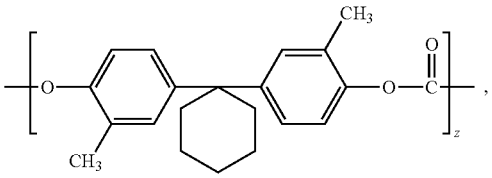

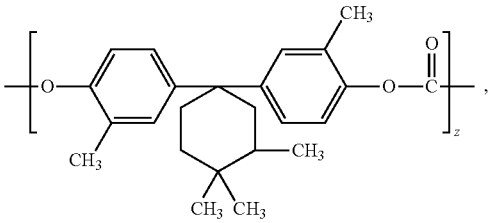

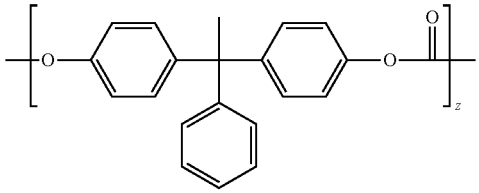

and mixtures thereof, wherein z represents the degree of polymerization and is from about 20 to about 80, and further wherein the polycarbonate is present in the polymer blended binder in an amount of from about 95 percent to about 99 percent by weight of the total weight of the polycarbonate and organic acid-containing copolyester and the organic acid-containing copolyester is present in the polymer blended binder in an amount of from about 1 percent to about 5 percent by weight of the total weight of the polycarbonate and organic acid-containing copolyester.

Yet another embodiment, there is an image forming apparatus for forming images on a recording medium comprising: an image forming apparatus for forming images on a recording medium comprising: a) an imaging member having a charge retentive-surface for receiving an electrostatic latent image thereon, wherein the imaging member comprises a flexible substrate, a charge generating layer disposed on the substrate, and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

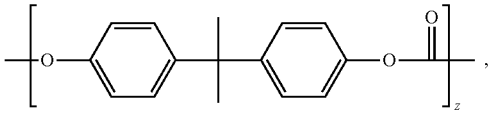

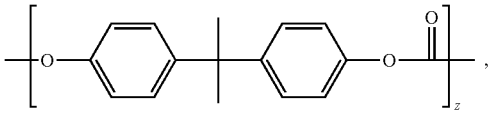

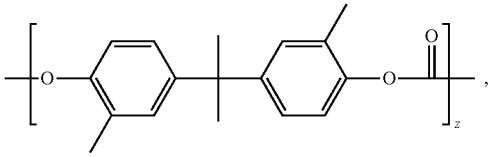

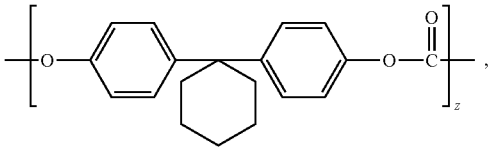

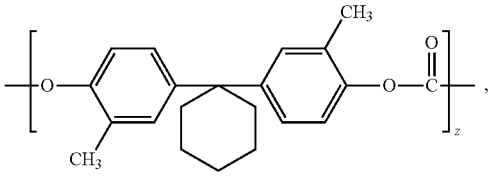

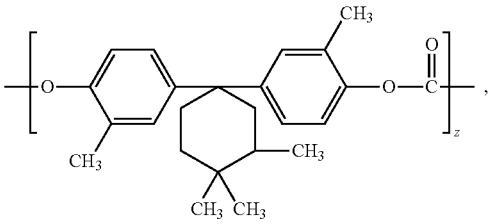

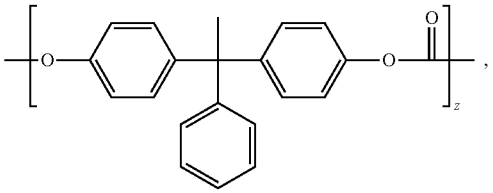

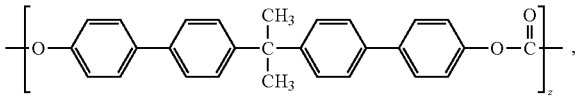

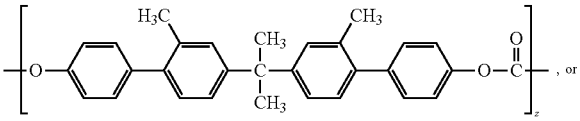

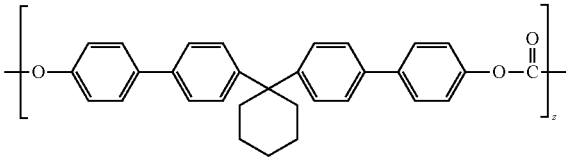

and mixtures thereof, wherein z represents the degree of polymerization and is from about 20 to about 80; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

BRIEF DESCRIPTION OF THE DRAWINGS

For a better understanding of the details of present disclosure, reference may be had to the accompanying figures.

DETAILED DESCRIPTION

Figure 1:
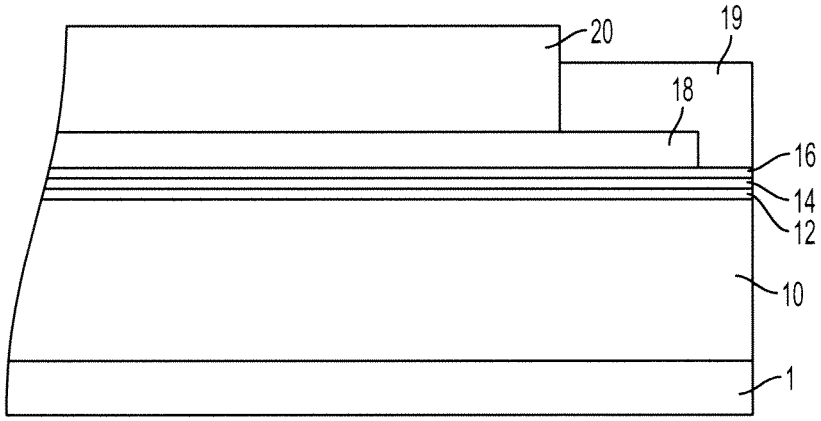
FIG. 1 is a cross-sectional view of a conventional flexible multilayered electrophotographic imaging member.

In the following description, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is provided flexible imaging members prepared to have two specific structural configurations, namely, a full flexible imaging member with an anticurl back coating layer and a structurally simplified imaging member without the anticurl back coating layer.

The Full Flexible Imaging Member

The flexible electrophotographic imaging member is comprised of a flexible substrate, a charge generating layer disposed on the substrate, and at least one charge transport layer disposed on the charge generating layer, and an anticurl back coating applied to the opposite side of the substrate to render imaging member flatness. The charge transport layer prepared according to the present disclosure comprises a charge transport compound of N,N'-diphenyl-N,N-bis(3-methylphenyl)-1,1-biphenyl-4,4'-diamine and a polymer blended/doped binder consisting of a film forming polycarbonate and an organic acid containing copolyester to render chemical amine protection. For purposes of this disclosure, the term "polymer blended/doped binder" or "polymer blended and doped binder" indicates that the binder of the present embodiments comprises smaller amounts of the copolyester blended and doped into the film forming polycarbonate.

In one specific embodiment, the disclosed charge transport layer in the flexible electrophotographic imaging member is formulated to comprise a charge transport component molecularly dispersed and/or dissolved in a polymer blended/doped binder comprising a film forming polycarbonate of bisphenol A polycarbonate, poly(4,4'-isopropylidene diphenyl carbonate), and an organic acid containing copolyester doped in smaller amounts into the bisphenol polycarbonate.

The bisphenol A polycarbonate has a weight average molecular weight (Mw) of from about 50,000 to about 200,000 and is given in the molecular formula below:

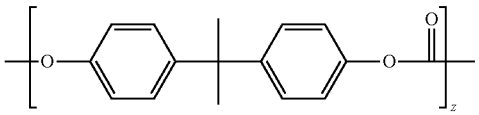

wherein z, the degree of polymerization, is a positive integer of between 20 and about 80. In imaging member of this example, the organic acid containing copolyester used to form the binder with bisphenol A polycarbonate in the disclosed charge transport layer is a linear saturated polymer of four diacids and ethylene glycol. It has a general Molecular Structure I represented in the following:

Molecular Structure I

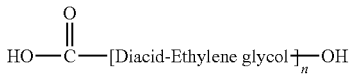

Molecular Structure I has a 1:1 mole ratio of diacid to ethylene glycol. The diacids are terephthalic acid, isophthalic acid, adipic acid, and azelaic acid in a mole ratio of 4:4:1:1.

In the example of another specific flexible electrophotographic imaging member embodiment, the copolyester used for blending/doping with bisphenol A polycarbonate is an alternative linear saturated polymer having Molecular Structure II shown below:

Molecular Structure II

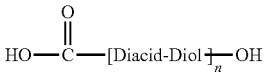

The mole ratio of diacid to diol in the copolyeater is 1:1 and the diacids are terephthalic acid and isophthalic acid in a mole ratio of 1.2:1. The two diols are ethylene glycol and 2,2-dimethyl propane diol in a mole ratio of 1.33:1.

For the above two structures, n is the degree of polymerization of the copolyester and generally can be any positive integer calculated from the weight average molecular weight of the specific copolyester. The polymer blended/doped binder used in each charge transport layer reformulation of the above imaging members is prepared to have a weight ratio of the polycarbonate to the organic acid containing copolyester of between about 99:1 and about 90:10 or between about 97:3 and about 95:5.

The Structurally Simplified Flexible Imaging Member

The structurally simplified flexible electrophotographic imaging member is an anticurl back coating-free imaging member. It is prepared in accordance with the same compositions/procedures used in the above embodiments described for the full flexible imaging member structure (comprising a flexible substrate, a charge generating layer disposed on the substrate, and at least one charge transport layer disposed on the charge generating layer) with the exception that there is no anticurl back coating layer. The charge transport layer comprises a charge transport compound of N,N'-diphenyl-N,N'-bis(3-methylphenyl)-1,1-biphenyl-4,4'-diamine, the polymer blended/doped binder comprising the film forming polycarbonate, and an organic acid containing copolyester doped into the polycarbonate, and further incorporates a liquid plasticizer to provide internal stress/stress relief for imaging member curl suppression and control. The resulting flexible imaging member is substantially curl free without the need of an anticurl back coating.

The liquid plasticizer selected for use requires: (a) a high boiling point of at least 250° C. to assure permanent presence in the layer, (b) miscibility with both the polymer blended/doped binder and the N,N'-diphenyl-N,N'-bis(3-methylphenyl)-1,1-biphenyl-4,4'-diamine such that its incorporation into the charge transport layer material matrix should cause no deleterious photoelectrical function of the resulting imaging member, and (c) ability to physically mix with the charge transport layer components for effecting Tg depression without chemically reacting or binding with the polymer blended binder.

The applicable plasticizers as selected for charge transport layer incorporation include high boiler liquid of phthalates, carbonates, and oligomeric styrenes as listed in the general molecular formulas below. The dialkyl phthalate and dicarbonate phthalates represented by the general Formula (I) shown below:

Formula (I)

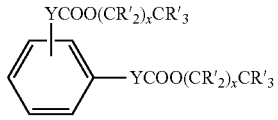

wherein Y is O or null, R' is H or F, and x is from null to 4. The diallyl phthalate and phenylene bis(allyl carbonate) of general Formula (II):

Formula (II)

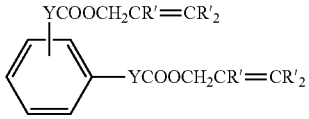

wherein Y is O or null, R' is H or F. The di-vinyl phthalates and phenylene bis(vinyl carbonate) liquids of any of the following compounds, alone or in combinations, according to the general Formula (III) below:

Formula (III)

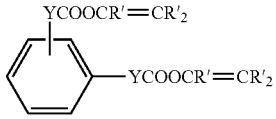

wherein Y is O or null, R' is H or F. The oligomeric styrene of Formula (IV) below:

Formula (IV)

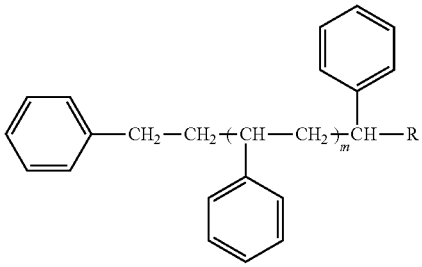

wherein R is selected from the group consisting of H, $CH_3$, $CH_2CH_3$, and $CH{=}CH_2$, and where m is between 0 and 3.

A typical conventional negatively charged flexible electrophotographic imaging member is illustrated in FIG. 1. The substrate 10 has an optional conductive layer 12. An optional hole blocking layer 14 disposed onto the conductive layer 12 is coated over with an optional adhesive layer 16. The charge generating layer 18 is located between the adhesive layer 16 and the charge transport layer 20. An optional ground strip layer 19 operatively connects the charge generating layer 18 and the charge transport layer 20 to the conductive ground plane 12, and an optional overcoat layer 32 is applied over the charge transport layer 20. An anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, polyethylene terephthalate (MYLAR) or polyethylene naphthalate (PEN) having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula [H2N(CH2)4]CH3Si(OCH3)2, and (gamma-aminopropyl) methyl diethoxysilane, which has the formula [H2N(CH2)3]CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder used for the charge generating layer 18 is PCZ-400 (poly(4,4'-dihydroxydiphenyl-1-1-cyclohexane) which has a molecular weight of about 40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the charge transport layer can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N-bis[3-methylphenyl]-[1,1'-biphenyl]-4,4'-diamine); N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018, 756, the disclosures of which are incorporated herein by reference in their entireties.

In one exemplary embodiment, charge transport layer 20 comprises an average of about 10 to about 60 weight percent N,N'-diphenyl-N,N'-bis(3-methylphenyl)-1,1'-biphenyl-4, 4'-diamine, or from about 30 to about 50 weight percent N,N'-diphenyl-N,N'-bis(3-methylphenyl)-1,1'-biphenyl-4, 4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

The charge transport layer 20 is a solid solution including a charge transport component, such as N,N'-diphenyl-N,N'-bis(3-methylphenyl)-1,1'-biphenyl-4,4'-diamine, molecularly dispersed/dissolved in a polycarbonate binder, the polycarbonate binder is typically a bisphenol A polycarbonate of poly(4,4'-isopropylidene diphenyl carbonate). The bisphenol A polycarbonate used for typical charge transport layer formulation is FPC 0170, having a molecular weight of about 120,000 and commercially available from Mitsubishi Chemicals Corp. The molecular structure of bisphenol A polycarbonate, poly(4,4'-isopropylidene diphenyl carbonate), is given in the formula below:

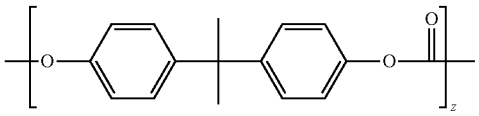

(bisphenol A polycarbonate)

wherein z indicates the degree of polymerization.

The charge transport layer 20 may have between about 10 and about 50 micrometers in thickness, or between about 20 and about 40 micrometers. Since the typical conventional charge transport layer 20 does have a substantially greater thermal contraction coefficient constant (3.7 times) compared to that of the support substrate 10, the prepared flexible electrophotographic imaging member (using a 3-mil flexible biaxially oriented PET substrate and say, for example, a 29 micrometers charge transport layer) will exhibit spontaneous upward curling, into a 1½ inch roll if unrestrained, due to the result of larger dimensional contraction in the charge transport layer 20 than the support substrate 10, as the imaging member cools from the glass transition temperature of the charge transport layer down to room ambient temperature of 25° C. after the heating/drying processes of the applied wet charge transport layer coating. The consequence of greater dimensional contraction of the charge transport layer 20 than that of the substrate support 10 after cooling causes internal tension build-up in the layer to pull the imaging member inwardly and result in imaging member curling.

An anti-curl back coating 1 of about 17 micrometers is therefore needed and applied to the back side of the support substrate 10 (which is the side opposite the side bearing the electrically active coating layers) to counteract against the effect of the 29-micrometer thick charge transport layer in order to fully control the curl and render the prepared imaging member with desired flatness.

The Anticurl Back Coating

Since the charge transport layer 20 is applied by solution coating process, the applied wet film is dried at elevated temperature and then subsequently cooled down to room ambient. The resulting imaging member web (comprising a 29 micrometers charge transport layer and a 3 mils PET substrate) if, at this point, not restrained, will spontaneously curl upwardly into a 1½ inch tube due to greater dimensional contraction and shrinkage of the Charge transport layer than that of the substrate support layer 10. An anti-curl back coating 1, as the conventional imaging member shown in FIG. 1, is then applied to the back side of the support substrate 10 (which is the side opposite the side bearing the electrically active coating layers) in order to render the prepared imaging member with desired flatness.

Generally, the anticurl back coating 1 comprises a thermoplastic polymer and an adhesion promoter. The thermoplastic polymer, in some embodiments being the same as the polymer binder used in the charge transport layer, is typically a bisphenol A polycarbonate, which along with the addition of an adhesion promoter of polyester are both dissolved in a solvent to form an anticurl back coating solution. The coated anticurl back coating 1 must adhere well to the support substrate 10 to prevent premature layer delamination during imaging member belt machine function in the field.

In a conventional anticurl back coating, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). To counteract the pulling effect of a 29 micrometers charge transport layer, the anticurl back coating of 17 micrometers in thickness is needed to control imaging member upward curling and provide flatness. A typical, conventional anticurl back coating formulation has a 92:8 weight ratio of polycarbonate to adhesive.

Figure 2:
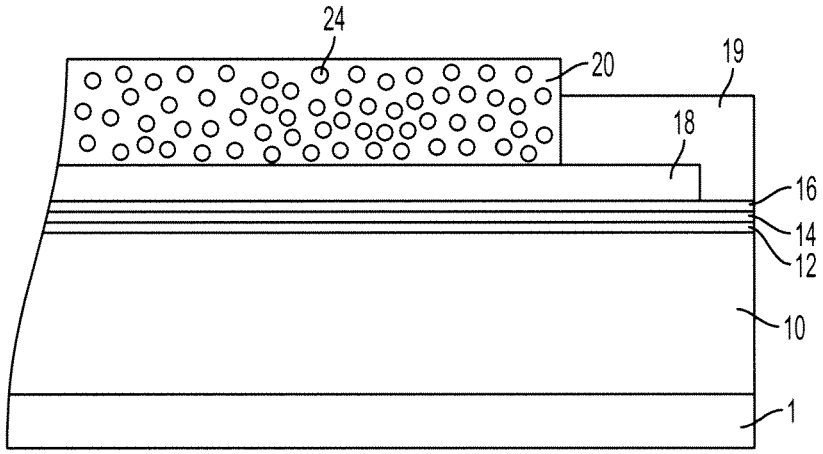
FIG. 2 is a cross-sectional view of a flexible multilayered electrophotographic imaging member having a single charge transport layer prepared according to the embodiments of present disclosure.

FIG. 2 discloses a full flexible imaging member structure prepared according to the present embodiments to give an amine species resistance charge transport layer. In the embodiments, the substrate 10, conductive ground plane 12, hole blocking layer 14, adhesive interface layer 16, charge generating layer 18, ground strip layer 16, charge transport layer 20, and anticurl back coating 1 of the disclosed imaging member are prepared to include the same materials, compositions, thicknesses, and follow the same procedures as those described in the conventional imaging member of FIG. 1, but with the exception that the bisphenol A polycarbonate binder in charge transport layer 20 is re-formulated to use a polymer blended/doped binder 24 according to the present embodiments. The polymer blended/doped binder 24 in the charge transport layer 20 comprises a blending of the bisphenol A polycarbonate and an organic acid containing copolyester.

According to aspects illustrated herein, there is provided a flexible imaging member comprising a flexible substrate 10, a conductive ground plane 12, a hole blocking layer, 14, an adhesive interface layer 16, a charge generating layer 18 disposed on the adhesive interface layer 16, a ground strip layer 16, and a charge transport layer 20 of present disclosure disposed on the charge generating layer 18, and an anticurl back coating 1 to maintain imaging member flatness. The charge transport layer 20 of this disclosure is a binary solid solution formulated to comprise a charge transport compound of N,N'-diphenyl-N,N'-bis(3-methylphenyl)-1,1-biphenyl-4,4'-diamine molecularly dispersed/dissolved in a polymer blended/doped binder 24. The polymer blended/doped binder 24 is prepared by mixing the bisphenol A polycarbonate poly(4,4'-isopropylidene diphenyl carbonate) and a specifically selected organic acid containing copolyester to effect amine species quenching/neutralization (by acid-base reaction) result as well as stabilizing the resulting imaging member electrical function.

In one example, the copolyester used to blend with bisphenol A polycarbonate and form the blending/doping binder 24 in the disclosed charge transport layer is a linear saturated polymer of four diacids and ethylene glycol. It has a general Molecular Structure (I) represented in the following:

Molecular Structure (I)

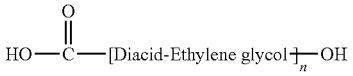

In one example, the copolyester of Molecular Structure (I) has a 1:1 mole ratio of diacid to ethylene glycol. The diacids are terephthalic acid, isophthalic acid, adipic acid, and azelaic acid in a mole ratio of 4:4:1:1. However, in another example of other copolyester, it a 1:1 mole ratio of diacid to ethylene glycol; the diacids are terephthalic acid and isophthalic acid in a mole ratio of 3:2.

In another example, the copolyester used for blending/doping with bisphenol A polycarbonate is an alternative linear saturated polymer having a Molecular Structure (II) shown below:

Molecular Structure (II)

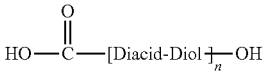

In this example, the mole ratio of diacid to diol in the copolyeater is 1:1 and the diacids are terephthalic acid and isophthalic acid in a mole ratio of 1.2:1. The two diols are ethylene glycol and 2,2-dimethyl propane diol in a mole ratio of 1.33:1. For the above two Molecular Structures (I) and (II), n is the degree of polymerization of the copolyester and generally can be any positive integer calculated from the weight average molecular weight of the specific copolyester.

In extended embodiments, the diacids in the above Molecular Structures (I) and (II) may alternatively include aromatic phthalic acid, aliphatic acid of glutaric acid, adipic acid, heptanedioic acid, octanedioic acid, azelaic acid, decanedioic acid, and the like as shown below:

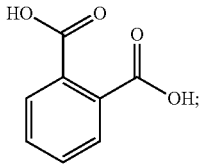

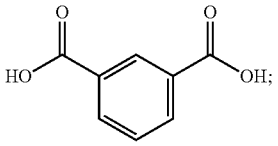

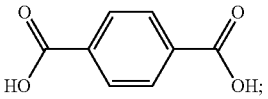

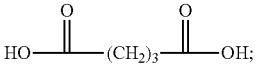

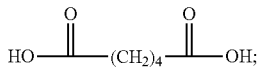

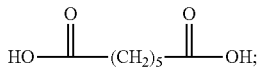

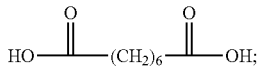

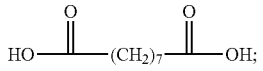

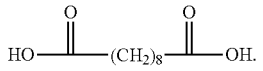

In yet further extended embodiments, the bisphenol A polycarbonate used to form the polymer blended/doped binder 24 may be replaced by an alternate polycarbonate selected from one of the groups shown below:

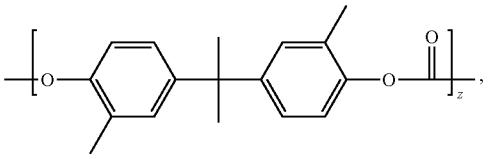

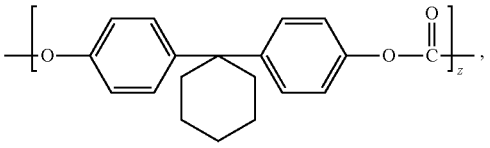

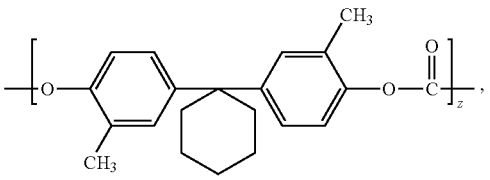

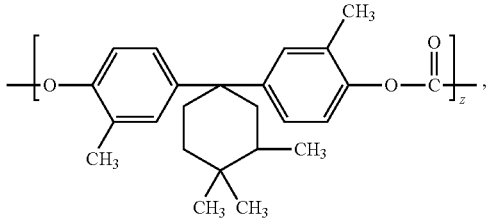

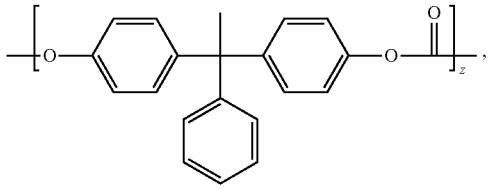

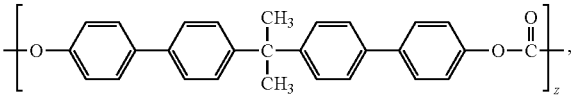

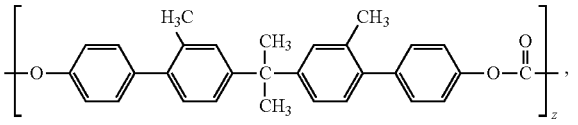

or

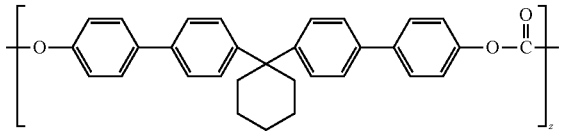

wherein z, the degree of polymerization, is a positive integer of between 20 and about 80.

In all of the above disclosed flexible imaging member embodiments, the weight ratio of charge transport compound N,N'-diphenyl-N,N'-bis(3-methylphenyl)-1,1-biphenyl-4,4'-diamine to polymer blended binder present in the disclosed charge transport layer 20 is from about 60 to about 40 or from about 30 to about 70 for providing optimum photo-electrical and mechanical performances. The polymer blended/doped binder 24 used in each charge transport layer reformulation of the above imaging members is prepared to have a weight ratio of the polycarbonate to the organic acid containing copolyester of between about 99:1 and about 90:10 or between about 97:3 and about 95:5. The resulting charge transport layer 20 thus prepared has a thickness of from about 20 to about 40 micrometers.

Figure 3:
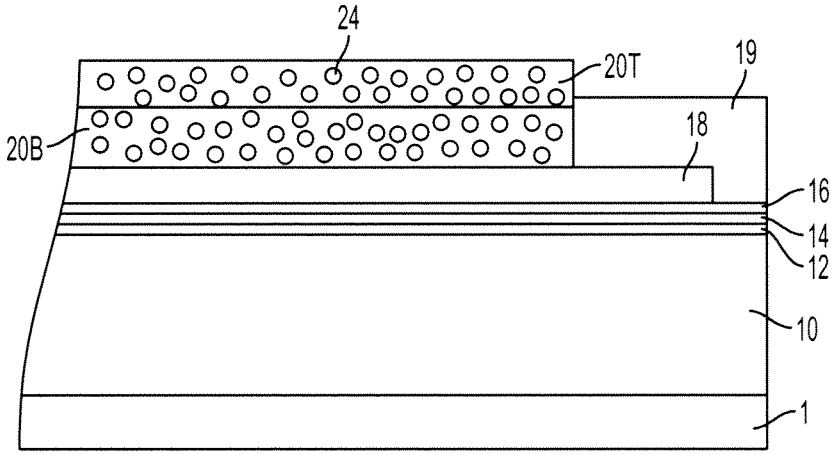
FIG. 3 is a cross-sectional view of a flexible multilayered electrophotographic imaging member having dual charge transport layers prepared according to the embodiments of present disclosure.

In the further extended embodiments, the flexible imaging member is prepared to comprise a substrate 10, conductive ground plane 12, hole blocking layer 14, adhesive interface layer 16, charge generating layer 18, ground strip layer 16, charge transport layer 20, and anticurl back coating 1 by following the same procedures and material compositions as those described in FIG. 2. The charge transport layer 20 is then redesigned to comprise dual layers: a bottom layer 20B and a top exposed layer 20T according to the illustration in FIG. 3. Both of these layers comprise about the same thickness and utilizing the polymer blended/doped binder 24 and same charge transport compound of N,N'-diphenyl-N,N'-bis(3-methylphenyl)-1,1-biphenyl-4,4'-diamine, with the bottom layer containing a greater amount of the charge transport compound than the top exposed layer. The charge transport compound present in the bottom layer 20B is between about 60 and about 80 weight percent while that in the top exposed layer 20T is between about 40 and about 20 weight percent based on the total weight of each respective layer to provide optimum photo-electrical and mechanical functions. In embodiments, both disclosed dual charge transport layers are of the same thickness and have a total thickness of between about 20 and about 40 micrometers.

Figure 4:
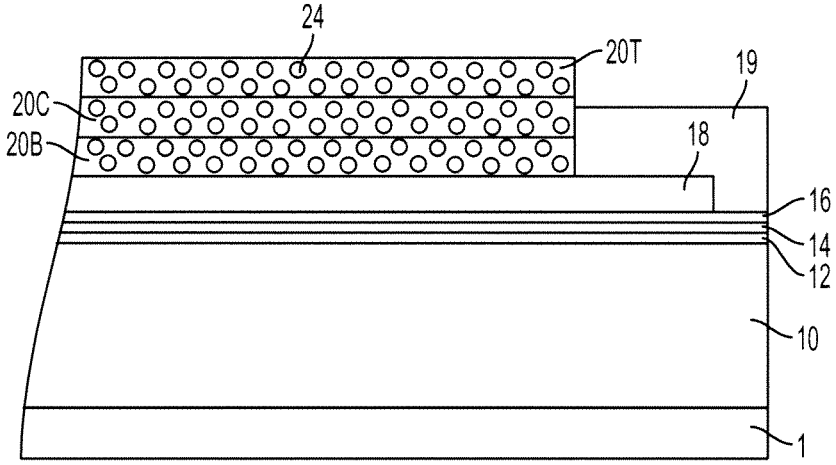
FIG. 4 is a cross-sectional view of a flexible multilayered electrophotographic imaging member having triple charge transport layers prepared according to an embodiment of present disclosure.

In yet further extended embodiments of flexible imaging member of the present disclosure, the charge transport layer is further re-formulated to have triple charge transport layers comprising a bottom layer 20B, center layer 20C, and top exposed layer 20T as shown in FIG. 4. All of the triple layers comprise about the same thickness and utilize the same A-B diblock copolymer binder 24 as well as same charge transport compound of N,N'-diphenyl-N,N'-bis(3-methylphenyl)-1,1-biphenyl-4,4'-diamine, with the bottom layer 20B containing the greatest and the top exposed layer 20T the least amount of the charge transport compound. The charge transport compound presence in the bottom layer 20B is from about 70 to about 90 weight percent, that in the center layer 20C is from about 40 to about 60 weight percent, and that in the top exposed layer 20T is from about 20 to about 30 weight percent based on the total weight of each respective layer. In embodiments, the disclosed triple charge transport layers are of the same thickness and have a total thickness of from about 20 to about 40 micrometers.

Figure 5:
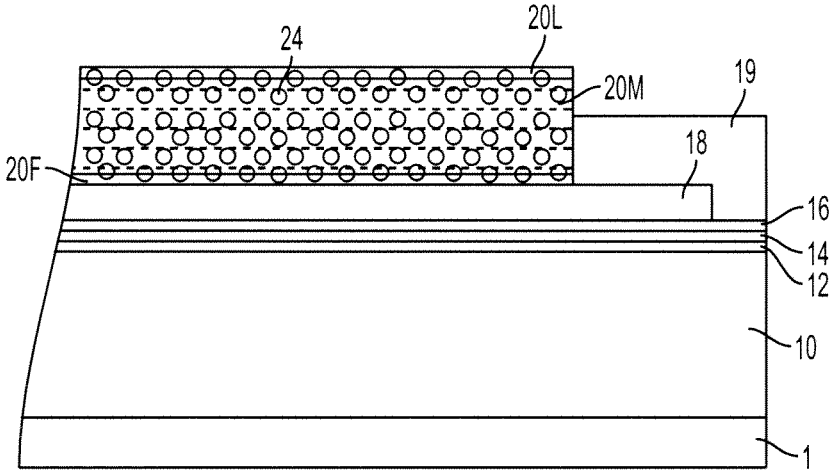
FIG. 5 is a cross-sectional view of a flexible multilayered electrophotographic imaging member having multiple charge transport layers prepared according to another embodiment of present disclosure.

In still yet further extended embodiments of flexible imaging member of this disclosure, the charge transport layer is further re-formulated to give multiple charge transport layers consisting of a first/bottom layer 20F, middle plurality of layers 20M, and last/top exposed layer 20L as shown in FIG. 5. All of these charge transport layers comprise about the same thickness and utilizing the same polymer blended/doped binder 24 and same charge transport compound of N,N'-diphenyl-N,N'-bis(3-methylphenyl)-1,1-biphenyl-4,4'-diamine, except that the amount of charge transport compound in each layer is decreasing in continuum starting from the first/bottom layer 20F reaches toward the last/top outermost exposed layer 20L of the imaging member, so that the lowest amount is present in the last outermost exposed layer. That means the content of the polymer blended/doped binder 24 in each charge transport layer is increased, starting from the lowest in first/bottom layer 20F and rising continuously toward the top such that the last/top outermost layer 20L has the highest content of polymer blended/doped binder 24. From optimum photo-electrical and mechanical function considerations, the charge transport compound presence in the first/bottom layer 20F is from about 70 to about 90 weight percent while that in the last/top exposed layer 20L is from about 20 to about 30 weight percent based on the total weight of each respective layer.

In the embodiments where the charge transport layer comprises multiple layers, with reference to FIG. 5, the layers may have a total of from about 4 to about 10 discreet layers, or from about 4 to about 6. While the thickness of each of the charge transport layers 20F, 20M, and 40L may be different, but they are preferably to be the same and range from about 0.5 to about 7 micrometers. Generally, the disclosed multiple charge transport layers have a total thickness of between about 20 and about 40 micrometers.

Figure 6:
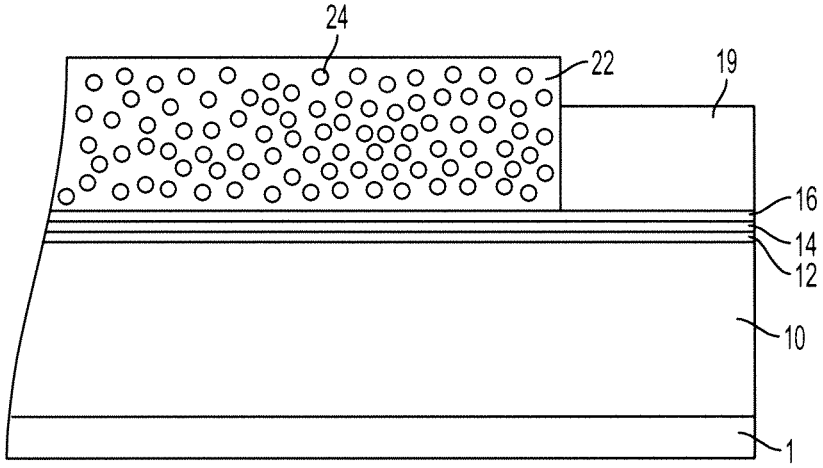
FIG. 6 is a cross-sectional view of an alternative flexible multilayered electrophotographic imaging member, having a single charge generating/transporting layer, prepared according to the embodiments of present disclosure.

As an alternative to the two discretely separated layers of a charge transport 20 and charge generation layers 18 as those described in FIG. 1, a simplified imaging member (shown in FIG. 6), having all other layers being formed in the same manners as described in preceding figures, may be created to contain a single imaging layer 22 which has both charge generating and charge transporting capabilities and with the use of the polymer blended/doped binder 24 as illustration. In a conventional electrophotographic imaging member design, for example U.S. Pat. No. 6,756,169, it was prepared to have a single imaging layer 22 that is comprised of a single electrophotographically active layer capable of retaining an electrostatic charge in the dark during electrostatic charging, imagewise exposure and image development. In the exemplary imaging member of the present disclosure shown in FIG. 6, the single imaging layer 22 is formed to include charge transport molecules and photogenerating/photoconductive pigments dispersion in a polymer blended/doped binder 24 comprising polycarbonate and organic containing copolyester according to the material descriptions previously detailed in the charge transport layer 20 and charge generation layer 18 of imaging member of FIG. 2.

In the example of structurally simplified electrophotographic imaging member embodiments, five imaging members of this disclosure are prepared to comprise a substrate 10, conductive ground plane 12, hole blocking layer 14, adhesive interface layer 16, charge generating layer 18, ground strip layer 16, and charge transport layer 20 in the same manners and using the same materials/compositions/thickness according to each description of FIGS. 2 to 6 in the full flexible imaging member embodiments disclosed above, but with the exception that the re-formulated charge transport layer is further refined to incorporate a liquid plasticizer to relieve its internal stress/strain to provide curl suppression and give a structurally simplified anticurl back coating-free imaging member. In other words, the inclusion of a liquid plasticizer in the amount of between about 5 and about 13 or between about 7 and about 10 weight percent into the re-formulated charge transport layer (based on the total weight of the resulting charge transport layer) to provide internal build-in stress/strain relief gives the resulting imaging member a curl-free configuration without the need of the anticurl back coating (ACBC).

The applicable plasticizers selected for charge transport layer plasticizing result include high boiler liquid of phthalates, carbonates, and oligomeric styrenes according to the molecular formulas described in the following.

Dialkyl phthalate and dicarbonate phthalates represented by Formula (I) shown below:

Formula (I)

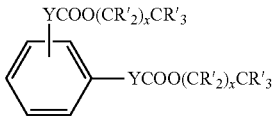

wherein Y is O or null, R' is H or F, and x is from null to 4. Illustrative examples of diakyl and dicarbonate phthalate plasticizers are

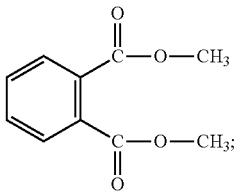
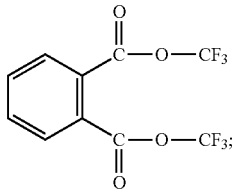
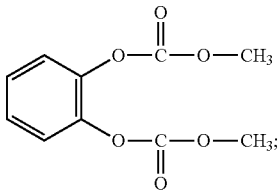
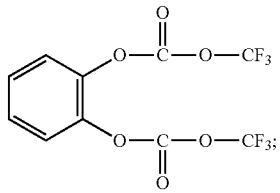
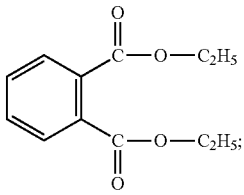
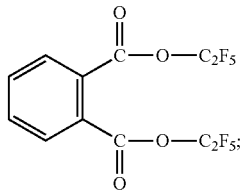
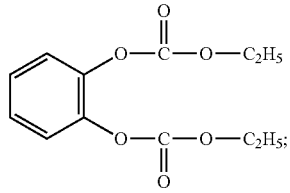
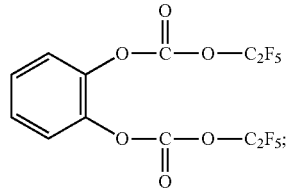
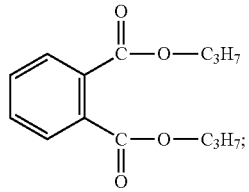
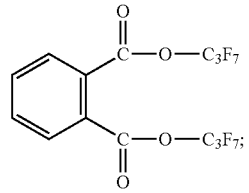
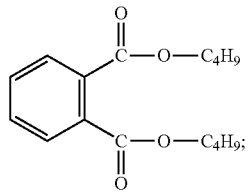
and the like.
The diallyl phthalate and bis(allyl carbonate) phthalate of Formula (II):
Formula (II)
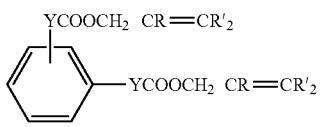
wherein Y is O or null, R' is H or F. Illustrative examples of diallyl phthalate and bis(allyl carbonate) phthlate are

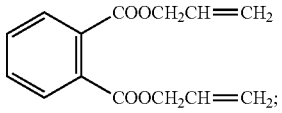
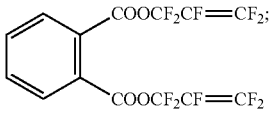
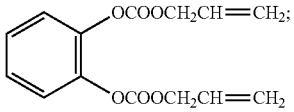
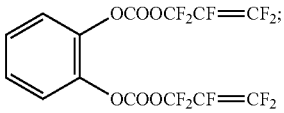
and the like.
The di-vinyl phthalates and phenylene bis(vinyl carbonate) are described according to Formula (III) shown below:
Formula (III)
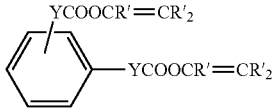
wherein Y is O or null, R' is H or F. Illustrative example of di-vinyl phthalate and phenylene bis(vinyl carbonate) are
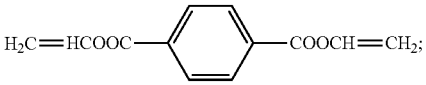
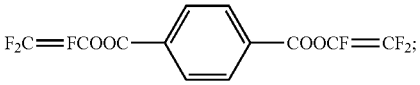
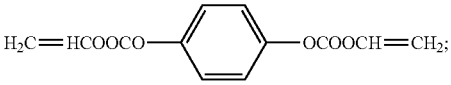
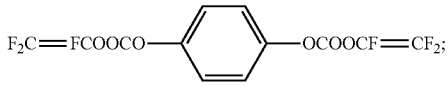
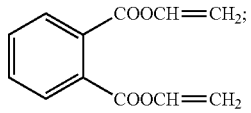
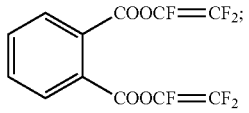
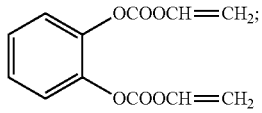
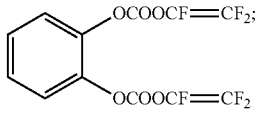
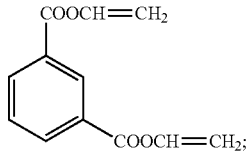
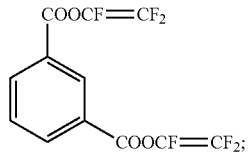
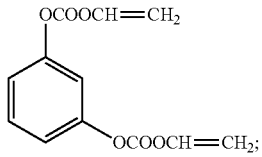

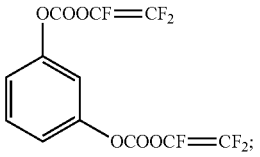

and the like.

Another plasticizer includes an oligomeric styrene having the formula below:

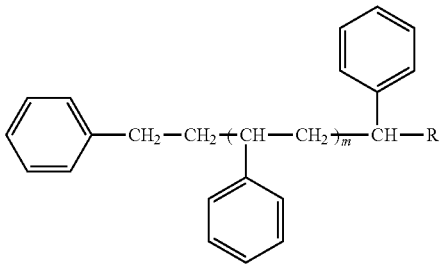

wherein R is selected from the group consisting of H, $CH_3$, $CH_2CH_3$, and $CH{=}CH_2$, while m is between 0 and 3.

Another plasticizer includes a styrene dimer of below formula

Formula (V)

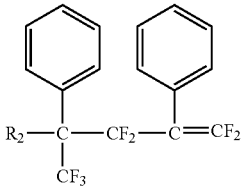

wherein $R_2$ is F, $CF_3$, and $CF_2CF_3$.

The benefit of using the modified plasticizing liquids having fluorinated molecular structures in the formulas (as presented above) for incorporating into the present charge transport layer embodiments is not only providing a plasticizing effect for imaging member curl control to provide anticurl back coating elimination, but also to render the resulting charge transport layer with surface lubricity and contact friction reduction to ease imaging member belt surface cleaning as well as toner image transfer to receiving papers during electrophotographic imaging and cleaning processes.

In summary, each of the flexible imaging members of present disclosure as described above, is prepared to contain a polymer blended/doped binder 24 (consisting of a polycarbonate and an organic acid containing copolyester) in the charge transport layer(s) to protect it against environmental chemical amine attack, such as for example, through chemical reaction of quenching/neutralization the basic amine species. All resulting imaging members, whether having a full or an ACBC-free simplified, have good interfacial adhesion bonding between charge transport layer and charge generation layer and preserve the photoelectrical integrity with respect to imaging member performance. That means, for example, having charge acceptance ($V_0$) in a range of from about 700 to about 850 volts; sensitivity (S) of between about 350 and about 400 volts/ergs/cm$^2$; residual potential ($V_r$) of less than about 100 volts; a depletion potential (Vdepl) of less than 90 volts. The ACBC-free imaging members prepared to include plasticizer incorporation into the re-formulated charge transport layer for providing internal stress/strain relief also provide an added benefit of having charge transport layer fatigue-bend cracking resistance enhancement for imaging member belt dynamic machine cyclic function in the field.

The resulting charge transport layer prepared according to the description of present disclosure (only the top exposed layer of the multiple layers) may otherwise contain a light shock resisting or reducing agent of from about 1 to about 6 weight percent, based on the total weight of the resulting charge transport layer. Such light shock resisting agents include 3,3',5,5'-tetra(t-butyl)-4,4'-diphenoquinone (DPQ); 5,6,11,12-tetraphenyl naphthacene (Rubrene); 2,2'-{cyclohexylidenebis[(2-methyl-4,1-phenylene)azo]}bis[4-cyclohexyl-(9Cl)]; perinones; perylenes; and dibromo anthanthrone (DBA). Additional aspects relate to the inclusion in the charge transport layer of variable amounts of an antioxidant, such as a hindered phenol. Exemplary hindered phenols include octadecyl-3,5-di-tert-butyl-4-hydroxyhydrocinnamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. application Ser. No. 10/655,882 incorporated by reference.

To further improve the disclosed imaging member's mechanical performance, the top charge transport layer, being a single layer or multiple layers, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement. One suitable particulate dispersion is described in U.S. Pat. No. 6,326,111, which is hereby incorporated by reference in its entirety.

The flexible multilayered electrophotographic imaging member fabricated in accordance with the embodiments of present disclosure, described in all the above preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible imaging belt thus may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limiting working examples below. They are, therefore in all respects, to be considered as illustrative and not restrictive nor limited to the materials, conditions, process parameters, and the like recited herein. The scope of embodiments is being indicated by the appended claims rather than the foregoing description. All changes that come within the meaning of and range of equivalency of the claims are intended to be embraced therein. All proportions are by weight unless otherwise indicated.

Control Imaging Member Preparation Example

A conventional negatively charged flexible electrophotographic imaging member web (as that illustrated in FIG. 1) was prepared by providing a 0.02 micrometer thick titanium layer 12 coated substrate of a biaxially oriented polyethylene naphthalate substrate 10 (PEN, available as KADALEX from DuPont Teijin Films) having a thickness of 3½ mils (89 micrometers), and extrusion coating the titanized KADALEX substrate with a blocking layer solution containing a mixture of 6.5 grams of gamma aminopropyltriethoxy silane, 39.4 grams of distilled water, 2.1 grams of acetic acid, 752.2 grams of 200 proof denatured alcohol and 200 grams of heptane. The resulting wet coating layer was allowed to dry for 5 minutes at 135° C. in a forced air oven to remove the solvents from the coating and effect the formation of a crosslinked silane blocking layer. The resulting blocking layer 14 had an average dry thickness of 0.04 micrometer as measured with an ellipsometer.

An adhesive interface layer 16 was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer (CGL 18) dispersion was prepared as described below:

To a 4 ounce glass bottle was added IUPILON 200, a polycarbonate of poly(4,4'-diphenyl)-1,1'-cyclohexane carbonate (PC-z 200, available from Mitsubishi Gas Chemical Corporation) (0.45 grams), and tetrahydrofuran (50 milliliters), followed by hydroxygallium phthalocyanine Type V (2.4 grams) and ⅛ inch (3.2 millimeters) diameter stainless steel shot (300 grams). The resulting mixture was placed on a ball mill for about 20 to about 24 hours to obtain a slurry. Subsequently, a solution of poly(4,4'-diphenyl-1,1'-cyclohexane carbonate) (2.25 grams) having a weight average molecular weight of 20,000 (PC-z 200) dissolved in tetrahydrofuran (46.1 grams) was added to the hydroxygallium phthalocyanine slurry. The resulting slurry was placed on a shaker for 10 minutes and thereafter coated onto the adhesive interface 16 by extrusion application process to form a layer having a wet thickness of 0.25 mil. A strip of about 10 millimeters wide along one edge of the substrate web stock bearing the blocking layer 14 and the adhesive layer 16 was deliberately left uncoated by the CGL 18 to facilitate adequate electrical contact by a ground strip layer to be applied later. The resulting CGL 18 containing poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer (CTL 20) and a ground strip layer 19 by co-extrusion of the coating materials. The CTL was prepared as described below:

To an amber glass bottle was added bisphenol A polycarbonate thermoplastic having an average molecular weight of about 120,000 (FPC 0170, commercially available from Mitsubishi Chemicals) and a charge transport compound of N,N'-diphenyl-N,N'-bis(3-methylphenyl)-1,1'-biphenyl-4,4'-diamine. The weight ratio of the bisphenol A polycarbonate thermoplastic and N,N'-diphenyl-N,N'-bis(3-methylphenyl)-1,1'-biphenyl-4,4'-diamine was 1:1. The resulting mixture was dissolved in methylene chloride such that the solid weight percent in methylene chloride was 15 percent by weight. Such mixture was applied on the CGL 18 by extrusion to form a coating which upon drying in a forced air oven gave a dry CTL 20 of 29 micrometers thick. The strip, about 10 millimeters wide, of the adhesive layer 16 left uncoated by the CGL 18, was coated with a ground strip layer 19 during the co-extrusion process. The ground strip layer coating mixture was prepared as described below:

To a carboy container was added 23.8 grams of bisphenol A polycarbonate resin (FPC 0170) and 332 grams methylene chloride. and methylene chloride (332 grams). The container was covered tightly and placed on a roll mill for about 24 hours until the polycarbonate was dissolved and gave a 7.9 percent by weight solution. The prepared solution was mixed for 15-30 minutes with about 94 grams of graphite dispersion solution (available as RW22790, from Acheson Colloids Company) to give ground strip layer coating solution. (Note: The graphite dispersion solution, RW22790 as commercially obtained, contained a 12.3 percent by weight solids including 9.41 parts by weight of graphite, 2.87 parts by weight of ethyl cellulose, and 87.7 parts by weight of solvent).

To effect homogeneous graphite dispersion, the resulting ground strip layer coating solution was then mixed with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL solution, to the electrophotographic imaging member web to form an electrically conductive ground strip layer 19 having a dried thickness of about 19 micrometers.

The imaging member web stock containing all of the above layers was then passed through 125° C. in a forced air oven for 3 minutes to simultaneously dry both the CTL 20 and the ground strip 19. Since the CTL has a Young's Modulus of $3.5\times10^5$ psi ($2.4\times10^4$ Kg/cm$^2$) and a thermal contraction coefficient of $6.5\times10^{-5}$/° C. compared to the Young's Modulus of $5.5\times10^5$ psi ($3.8\times10^4$ Kg/cm$^2$) and thermal contraction coefficient of $1.8\times10^{-5}$ for the PEN substrate support 10, the CTL 20 was about 3.6 times greater in dimensional shrinkage than that of PEN substrate support. Therefore, the imaging member web if unrestrained at this point would curl upwardly into a 1½-inch tube.

To effect imaging member curl control, a conventional anticurl back coating (ACBC) 1 was prepared by combining 88.2 grams of FPC 0170 bisphenol A polycarbonate resin, 7.12 grams VITEL PE-2200 copolyester (available from Bostik, Inc. Middleton, Mass.), and 1,071 grams of methylene chloride in a carboy container to form a coating solution containing 8.2 percent solids. The container was covered tightly and placed on a roll mill for about 24 hours until the polycarbonate and polyester were dissolved in methylene chloride to form an anti-curl back coating solution. The ACBC coating solution as prepared was then applied to the rear surface (side opposite to the charge generating layer and CTL) of the electrophotographic imaging member web by extrusion coating and dried to a maximum temperature of 125° C. in a forced air oven for about 3 minutes to produce a dried ACBC 1 having a thickness of 17 micrometers and flattening the imaging member.

Disclosure Imaging Member Preparation Example I

Three negatively charged flexible electrophotographic imaging member web, as that illustrated in FIG. 2, were prepared in the very same procedures and material compositions as those disclosed in the above Control Imaging Member Preparation section, but with the exception that the conventional CTL 20 was re-formulated by totally replacing the bisphenol A polycarbonate binder in the CTL 20 by using a polymer blended/doped binder 24 consisting of bisphenol A polycarbonate and an organic acid containing copolyester in three different blending weight ratios. The weight ratios of bisphenol A polycarbonate to copolyester used to form polymer blended binder 24 were 99:1; 97:3; and 95:5 in each respective CTL. The bisphenol A polycarbonate (available as FPC 0170 from Mitsubishi Chemicals Corp.) had a weight average molecular weight of about 120,000 and a molecular formula of

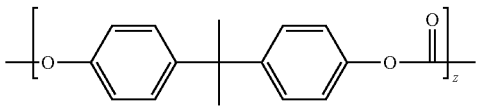

wherein z is degree of polymerization.

The copolyester used for blending/doping with the polycarbonate in binder 24 was Vitel PE 200 (available from Bostkl Inc.) and had a weight average molecular weight of 50,000 and a molecular structure of

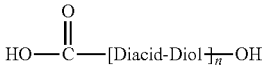

wherein n is degree of polymerization. In this copolyester, the mole ratio of diacid to diol in the copolyeater is 1:1 and the diacids are terephthalic acid and isophthalic acid in a mole ratio of 1.2:1. The two diols are ethylene glycol and 2,2-dimethyl propane diol in a mole ratio of 1.33:1.

The resulting imaging members having three variances polymer blended/doped binder 24 in their respective 29 micrometers thick CTL as prepared according to this disclosure were each required a 19 micrometer ACBC to effect curl control and provide flatness.

Disclosure Imaging Member Preparation Example II

Three negatively charged flexible electrophotographic imaging member web were prepared in the very same procedures and material compositions as those disclosed in the above Disclosure Imaging Member Preparation I, but with the exception that the application of ACBC was eliminated and the re-formulated CTL 20, comprising 99:1; 97:3; and 95:5 weight ratios of bisphenol A polycarbonate to copolyester polymer blended binder 24 in each respective layer, was further refined by incorporation of 8 weight percent of diethyl phthalate (DEP) in each respective layer material matrix (based on the resulting weight of each plasticized layer) to relieve internal stress/strain and provide curl control. The resulting ACBC free imaging member web had a substantially curl free configuration.

For imaging member curl assessment, a 2 inch by 10 inch sample piece was cut out from each ACBC free imaging member and then left freely unrestrained standing on a bench top for visual observation. Each sample piece was seen to have a substantially, nearly flat configuration with the exhibition of slightly upward curling of about 26 inches of diameter of curvature. The resulting ACBC-free imaging member as prepared was then used to serve as second imaging member Control.

The plasticizer DEP (available from Sigma-Aldrich Company) selected for use to formulate CTL 20P has a boiling point of about 250° C. and a molecular formula shown below:

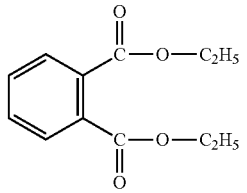

Photoelectrical Assessment and Physical/Mechanical Property

The photoelectrical properties of the imaging member web of the Control and the Disclosure Examples were determined at constant current by using the 4000 scanner. The surface contact friction was measured against elastomeric polyurethane cleaning black, while CTL/CGL adhesion bonding was carried out by 180° peel strength. All the measurement results thus obtained are summarized as follows:

The disclosed imaging member prepared to have a CTL, re-formulated by employing a polymer blended/doped binder consisting of a polycarbonate and an organic acid containing copolyester according to this disclosure for providing amine compound elimination/neutralization, did not cause any adverse impact to photoelectrical integrity as compared to the original imaging member control.

The imaging members having disclosed CTL prepared to containing 1, 3, and 5% wt copolyester in the polymer blended binder had shown about 18 to about 25%; about 15 to about 55%, and about 7 to about 13% of photosensitivity increases, respectively, compared to the conventional imaging member control counterpart.

All of the imaging members of this disclosure were more electrically stable by their exhibition of less Photo Induce Discharge Cycle-up, lower residual voltage, and lower dark decay than the control imaging member.

Refinement of the re-formulated CTL of this disclosure, by incorporation of a liquid plasticizer to relieve its internal stress/strain, was effective to give curl suppression/control for ACBC elimination.

The plasticized CTL of ACBC free imaging member was not only an easily production implementable/cost-cutting approach as well as stabilizing the photoelectrical performance, it could also give an added benefit of extending the imaging member belt machine cyclic function CTL fatigue cracking life in the field.

Both CTL reformulations (with and without plasticizer in corporation) of the disclosed imaging members had shown excellent adhesion bonding strength to the contiguous CGL and surface contact friction against cleaning blade equivalent to the control CTL of the conventional imaging member.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A flexible imaging member comprising:

a flexible substrate;

a charge generating layer disposed on a first side of the substrate; and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

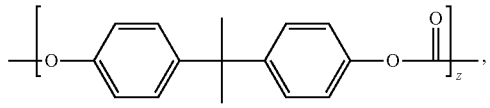

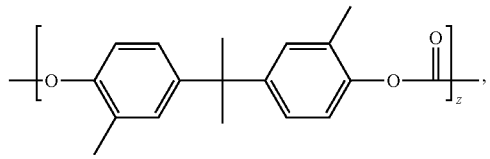

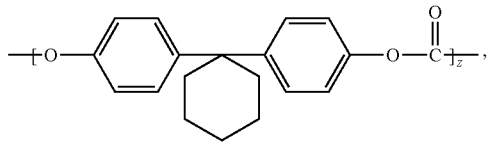

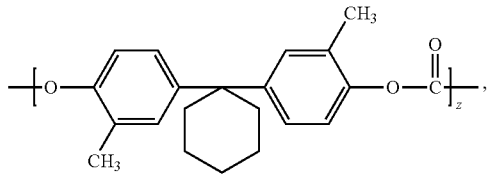

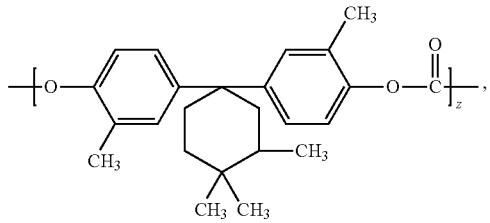

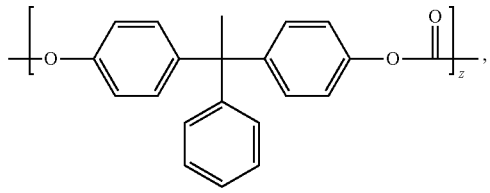

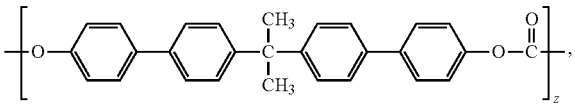

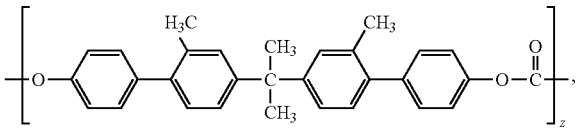

or

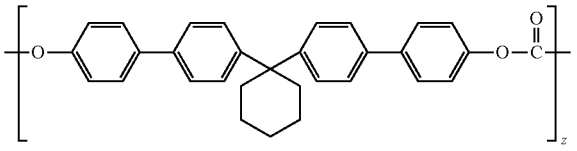

and mixtures thereof, wherein z represents the degree of polymerization and is from about 20 to about 80;

wherein the organic acid-containing copolyester having a general molecular structure of:

Molecular Structure (I)

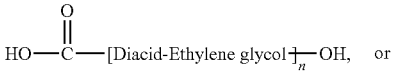

or

Molecular Structure (II)

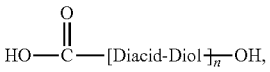

wherein n is the degree of polymerization of the copolyester; further wherein the organic acid-containing copolyester is present in the polymer blended binder in an amount of from about 1 percent to about 5 percent by weight of the total weight of the polycarbonate and organic acid-containing copolyester.

2. The flexible imaging member of claim 1, wherein the polycarbonate is present in the polymer blended binder in an amount of from about 95 percent to about 99 percent by weight of the total weight of the polycarbonate and organic acid-containing copolyester.

3. The flexible imaging member of claim 1, wherein the at least one charge transport layer further comprises a plasticizer compound.

4. The flexible imaging member of claim 3, wherein the plasticizer compound in the at least one charge transport layer is selected from the group consisting of phthalates, carbonates, and oligomeric styrenes having the following formulas:

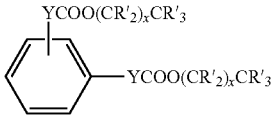

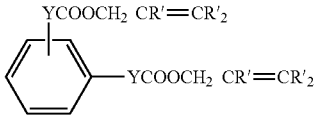

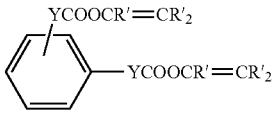

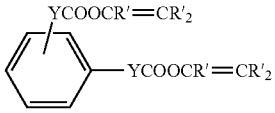

wherein Y is O or zero, R' is H or F, and x is from 0 to 4.

5. The imaging member of claim 1, wherein the charge transport layer is a dual-layer including a bottom charge transport layer and a top exposed charge transport layer disposed on the bottom charge transport layer, and further wherein both the bottom and the top exposed charge transport layers have the same thickness with a total thickness of from about 20 to about 40 micrometers.

6. The imaging member of claim 5, wherein the charge transport component present in the bottom charge transport layer in an amount of from about 60 to about 80 weight percent and is present in the top exposed charge transport layer in an amount of from about 20 to about 40 weight percent, based on the total weight of the charge transport compound and polymer blended binder in each respective layer.

7. The imaging member of claim 1, wherein the charge transport layer is a triple-layer including a bottom charge transport layer, a center charge transport layer disposed on the bottom charge transport layer, and a top exposed charge transport layer disposed on the center charge transport layer, and further wherein each of the three charge transport layers have the same thickness with a total thickness of from about 20 to about 40 micrometers.

8. The imaging member of claim 7, wherein the charge transport component is present in the bottom charge transport layer in an amount of from about 70 to about 90 weight percent, is present in the center charge transport layer in an amount of from about 40 to about 60 weight percent, and is present in the top exposed charge transport layer in an amount of from about 20 to about 30 weight percent based on the total weight of the charge transport compound and the polymer blended binder in each respective layer.

9. The imaging member of claim 1, wherein the charge transport layer comprises multiple layers including a bottom charge transport layer, a plurality of middle charge transport layers disposed on the bottom charge transport layer, and a top exposed charge transport layer disposed on the plurality of middle charge transport layers.

10. The imaging member of claim 9, wherein the multiple charge transport layers comprises from about 4 to about 15 charge transport layers or from about 4 to about 6 charge transport layers, and further wherein each of the multiple charge transport layers have the same thickness with a total thickness of from 20 to about 40 micrometers.

11. The imaging member of claim 10, wherein the amount of charge transport component present in the multiple charge transport layers decreases in continuum from the bottom charge transport layer to the top exposed charge transport layer.

12. The imaging member of claim 11, wherein the charge transport component is present in the bottom charge transport layer in an amount of from about 70 to about 90 weight percent and is present in the top exposed charge transport layer in an amount of from about 20 to about 30 weight percent based on the total weight of the charge transport compound and the polymer blended binder in each respective layer.

13. The flexible imaging member of claim 3 being curl-free without use of an anticurl back coating layer.

14. The flexible imaging member of claim 1 further including an anticurl back coating positioned on a second side of the substrate opposite to the charge generating layer and the at least one charge transport layer.

15. The flexible imaging member of claim 1, wherein the organic acid-containing copolyester is selected from the group consisting of: a linear saturated polymer of four diacids and ethylene glycol having a general molecular structure of:

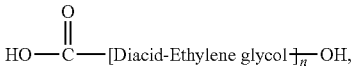

having a weight average molecular weight (Mw) of about 70,000 and a 1:1 mole ratio of diacid to ethylene glycol, wherein the diacids are terephthalic acid, isophthalic acid, adipic acid, and azelaic acid in a mole ratio of 4:4:1:1; a linear saturated polymer of four diacids and ethylene glycol having a general molecular structure of:

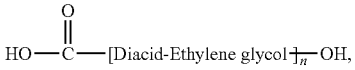

having a weight average molecular weight (Mw) of about 50,000 and a 1:1 mole ratio of diacid to ethylene glycol, wherein the diacids are terephthalic acid and isophthalic acid in a mole ratio of 3:2; and a linear saturated polymer of four diacids and ethylene glycol having a general molecular structure of:

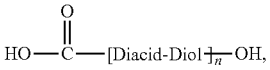

having a weight average molecular weight (Mw) of about 45,000 and a 1:1 mole ratio of diacid to diol, wherein the diacids are terephthalic acid and isophthalic acid in a mole ratio of 1.2:1 and the two diols are ethylene glycol and 2,2-dimethyl propane diol in a mole ratio of 1.33:1; and mixtures thereof.

16. The flexible imaging member of claim 15, wherein the diacids in the organic acid-containing copolyester is selected from the group consisting of the following:

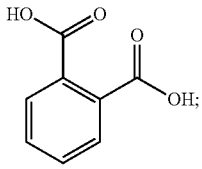

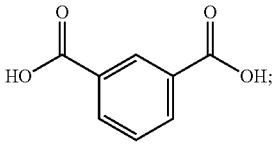

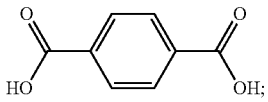

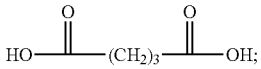

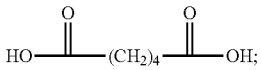

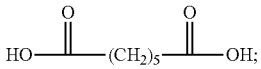

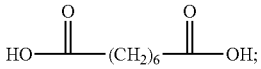

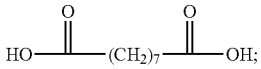

and

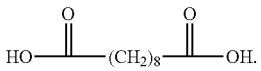

17. A flexible imaging member comprising:

a flexible substrate;

a charge generating layer disposed on a first side of the substrate; and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

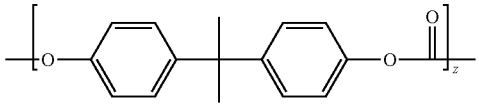

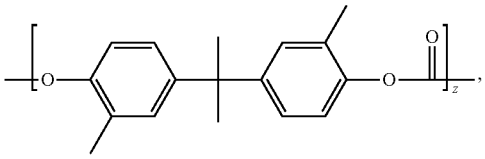

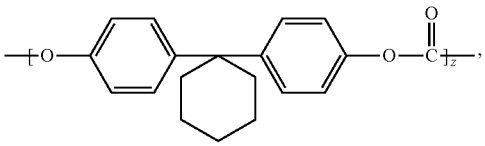

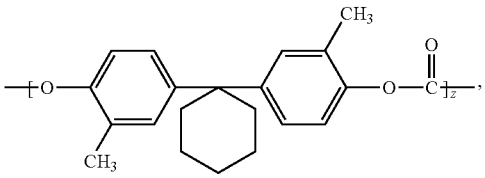

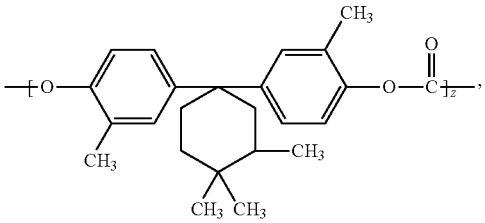

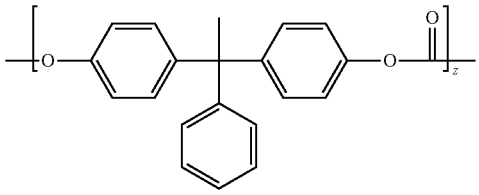

and mixtures thereof, wherein z represents the degree of polymerization and is from about 20 to about 80, and further wherein the polycarbonate is present in the polymer blended binder in an amount of from about 95 percent to about 99 percent by weight of the total weight of the polycarbonate and organic acid-containing copolyester and the organic acid-containing copolyester is present in the polymer blended binder in an amount of from about 1 percent to about 5 percent by weight of the total weight of the polycarbonate and organic acid-containing copolyester; wherein the organic acid-containing copolyester having a general molecular structure of:

Molecular Structure (I)

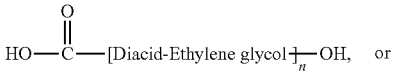

Molecular Structure (II)

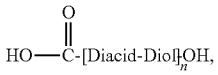

wherein n is the degree of polymerization of the copolyester; further wherein the organic acid-containing copolyester is present in the polymer blended binder in an amount of from about 1 percent to about 5 percent by weight of the total weight of the polycarbonate and organic acid-containing copolyester.

18. An image forming apparatus for forming images on a recording medium comprising:

a) an imaging member having a charge retentive-surface for receiving an electrostatic latent image thereon, wherein the imaging member comprises a flexible substrate, a charge generating layer disposed on the substrate, and at least one charge transport layer disposed on the charge generating layer, wherein the charge transport layer comprises a charge transport compound dispersed in a polymer blended binder, the polymer blended binder comprising a polycarbonate and an organic acid-containing copolyester doped into the polycarbonate, the polycarbonate being a bisphenol-type polycarbonate having a formula selected from the group consisting of

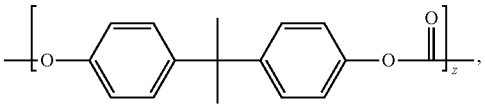

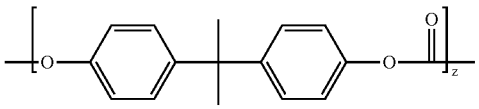

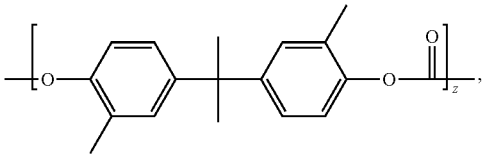

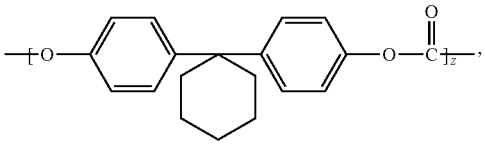

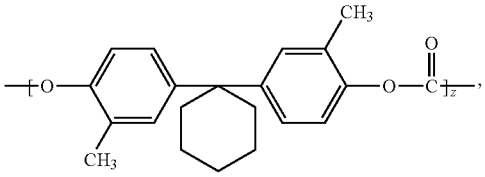

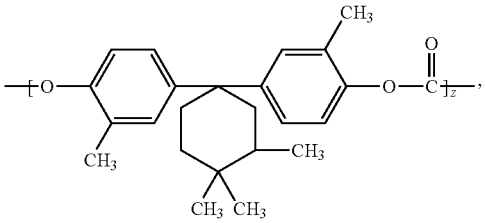

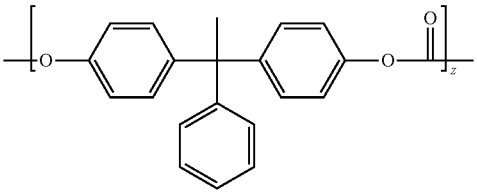

and mixtures thereof, wherein z represents the degree of polymerization and is from about 20 to about 80; wherein the organic acid-containing copolyester having a general molecular structure of:

Molecular Structure (I)

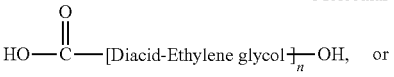

Molecular Structure (II)

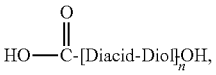

wherein n is the degree of polymerization of the copolyester; further wherein the organic acid-containing copolyester is present in the polymer blended binder in an amount of from about 1 percent to about 5 percent by weight of the total weight of the polycarbonate and organic acid-containing copolyester;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

19. The image forming apparatus of claim 18, wherein the charge transport layer further comprises a plasticizer compound and the imaging member is curl-free without use of an anticurl back coating layer.

20. The image forming apparatus of claim 18, wherein the imaging member further includes an anticurl back coating positioned on a second side of the substrate opposite to the charge generating layer and the at least one charge transport layer.

* * * * *